US009400129B2

(12) United States Patent
Kim et al.

(10) Patent No.: US 9,400,129 B2
(45) Date of Patent: Jul. 26, 2016

(54) APPARATUS FOR CONTROLLING AN AIR CONDITIONER AND A METHOD FOR OPERATING THE SAME

(71) Applicant: LG ELECTRONICS INC., Seoul (KR)

(72) Inventors: Seontaek Kim, Changwon-si (KR); Jiun Sohn, Changwon-si (KR); Seungjin Han, Changwon-si (KR); Seongjin Shin, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 219 days.

(21) Appl. No.: 14/077,423

(22) Filed: Nov. 12, 2013

(65) Prior Publication Data

US 2014/0130524 A1 May 15, 2014

(30) Foreign Application Priority Data

Nov. 12, 2012 (KR) ..... 10-2012-0127474

(51) Int. Cl.
*F25B 49/00* (2006.01)
*F24F 11/00* (2006.01)

(52) U.S. Cl.
CPC ..... *F25B 49/00* (2013.01); *F24F 11/0086* (2013.01); *F24F 2011/0091* (2013.01)

(58) Field of Classification Search
CPC ..... F24F 11/0086; F24F 2011/0091; F24F 1/01; F24F 11/001; F24F 2011/0052; F25B 49/00
See application file for complete search history.

(56) References Cited

U.S. PATENT DOCUMENTS

| | | | | |
|---|---|---|---|---|
| 8,788,104 | B2 * | 7/2014 | Kowald | F24F 11/0009 700/276 |
| 2002/0011923 | A1 * | 1/2002 | Cunningham | H04B 3/542 340/12.32 |
| 2002/0029096 | A1 * | 3/2002 | Takai | F24F 11/0086 700/276 |
| 2003/0140637 | A1 * | 7/2003 | Masui | F24F 11/006 62/127 |
| 2005/0097905 | A1 * | 5/2005 | Kwon | F24F 11/006 62/157 |
| 2005/0109048 | A1 * | 5/2005 | Lee | F24F 1/0007 62/126 |

(Continued)

FOREIGN PATENT DOCUMENTS

| | | |
|---|---|---|
| CN | 1786605 | 6/2006 |
| CN | 101403523 | 4/2009 |

(Continued)

OTHER PUBLICATIONS

European Search Report dated Jan. 30, 2014.

(Continued)

*Primary Examiner* — Emmanuel Duke
(74) *Attorney, Agent, or Firm* — Ked & Associates LLP

(57) ABSTRACT

An apparatus for controlling an air conditioner and a method for operating the same are provided. The apparatus may include a control apparatus that enables easy access to data for the air conditioner, to determine and control an operation state thereof visually, and for which a mode of reception of the data from the air conditioner may be different corresponding to connection modes and positions of a plurality of component devices of the air conditioner to which the control apparatus is connected, making the data received thus different from one another according to the connection modes. These differences in the data permit various data to be easily displayed, enabling a user to change the connection modes as required, and to provide various information on the air conditioner by producing the data of the air conditioner in a frame on an output different from one another.

25 Claims, 10 Drawing Sheets

(56) References Cited

U.S. PATENT DOCUMENTS

| | | | | |
|---|---|---|---|---|
| 2005/0229610 | A1* | 10/2005 | Park | F24F 1/0007 62/126 |
| 2009/0057424 | A1* | 3/2009 | Sullivan | F24F 11/0009 236/51 |

FOREIGN PATENT DOCUMENTS

| | | | |
|---|---|---|---|
| CN | 101424426 | | 5/2009 |
| EP | 2 306 104 | | 4/2011 |
| JP | H08-210694 | A | 8/1996 |
| KR | 10-2006-0064822 | A | 6/2006 |
| KR | 10-0680218 | B1 | 2/2007 |
| KR | 10-2007-0108648 | | 11/2007 |
| KR | 10-2008-0050696 | | 6/2008 |
| KR | 10-2008-0059909 | A | 7/2008 |
| KR | 10-2009-0041604 | | 4/2009 |
| KR | 10-2010-0123487 | A | 11/2010 |

OTHER PUBLICATIONS

Korean Office Action dated Apr. 4, 2014. (0127472).
Korean Office Action c ed Apr. 4, 2014. (0127474).
Korean Office Action dated Oct. 29, 2014 issued in Application No. 10-2012-0127472.
U.S. Appl. No. 14/177,417, filed Nov. 12, 2013, Frantz F. Jules.
U.S. Appl. No. 14/077,428, filed Nov. 12, 2013, Frantz F. Jules.
Chinese Office Action dated Nov. 4, 2015.
Korean Notice of Allowance dated Jan. 2, 2015, issued in Application No. 10-2012-0127474.

* cited by examiner

FIG. 8

361

HD Gr.1 | ◄ HR Gr.1 ► | MORE INFORMATION ON INDOOR DEVICE

362

| | PIPELINE1 | PIPELINE2 | PIPELINE3 | PIPELINE4 | EEV | LIQUID TUBE | PIPELINEin | PIPELINE out | ADDITIONAL INFORMATION |
|---|---|---|---|---|---|---|---|---|---|
| HRU0 | 0 | 0 | 0 | 0 | 0 | 300.00 | 300.00 | 300.00 | 0 |

HD Gr.1 | ◄ HR Gr.1 ► | MORE INFORMATION ON INDOOR DEVICE

363

| | FOUND IDU | NUMBER OF IDU SETS | Search | Enable | | | | | |
|---|---|---|---|---|---|---|---|---|---|
| HRU1 | 10 | 4 | ING | | | | | | |

FIG. 9

365

HD Gr.1 | ◄ HR Gr.1 ► | MORE INFORMATION ON INDOOR DEVICE

366

| | PIPELINE1 | PIPELINE2 | PIPELINE3 | PIPELINE4 | EEV | LIQUID TUBE | PIPELINEin | PIPELINE out | ADDITIONAL INFORMATION |
|---|---|---|---|---|---|---|---|---|---|
| HRU0 | 0,0 | 0,0 | 0,0 | 0,0 | 0 | 300.00 | 300.00 | 300.00 | 0 |

HD Gr.1 | ◄ HR Gr.1 ► | MORE INFORMATION ON INDOOR DEVICE

367

| | FOUND IDU | NUMBER OF IDU SETS | IDU#1 | IDU#2 | IDU#3 | Search | Enable | ERROR | |
|---|---|---|---|---|---|---|---|---|---|
| HRU1 | 0 | 0 | 0,0,0 | 0,0 | 0,0,0 | | | 0 | |

FIG. 10

371 372

| IDU3 WHU | IDU4 CASCADE |
|---|---|
| INDOOR DEVICE NUMBER | INDOOR DEVICE NUMBER |
| WATERPUMP | WATERPUMP |
| WARM WATER MODE | WARM WATER MODE |
| TARGET WARM WATER | HEATER MODE |
| WARM WATER TEMPERATURE | HEATSINK TEMPERATURE |
| INLET WATER TEMPERATURE | WARM WATER MODE |
| OUTLET WATER TEMPERATURE | HIGH PRESSURE |
| TEMPERATURE DIFFERENCE | COMP TARGET |
| HEATER MODE | COMP PRESENT |
| HEATER OUTLET WATER TEMPERAURE | COMP1 PHASE VOLTAGE |
| FCU | COMP1 PHASE VOLTAGE |
| BYPASS | EEV |
| RELAY1 | INLET WATER TEMPERATURE |
| RELAY2 | OUTLET WATER TEMPERATURE |
| 2WAY | SUCTION TEMPERATURE |
| 3WAY | DISCHARGE TEMPERATURE |
| | ERROR CODE |
| | FCU |
| | BY PASS |
| | FLOW SW |
| | RELAY1 |
| | RELAY2 |
| | 4WAY |
| | HOTGAS |
| | |
| | |
| | |

FIG. 11

373 374

| IDU3 WHU | IDU4 CASCADE |
|---|---|
| INDOOR DEVICE NUMBER | INDOOR DEVICE NUMBER |
| WATERPUMP | WATERPUMP |
| WARM WATER MODE | WARM WATER MODE |
| TARGET WARM WATER | HEATER MODE |
| WARM WATER TEMPERATURE | HEATSINK TEMPERATURE |
| INLET WATER TEMPERATURE | WARM WATER MODE |
| OUTLET WATER TEMPERATURE | HIGH PRESSURE |
| TEMPERATURE DIFFERENCE | COMP TARGET |
| HEATER MODE | COMP PRESENT |
| HEATER OUTLET WATER TEMPERAURE | COMP1 PHASE VOLTAGE |
| FCU | COMP1 PHASE VOLTAGE |
| BYPASS | EEV |
| RELAY1 | INLET WATER TEMPERATURE |
| RELAY2 | OUTLET WATER TEMPERATURE |
| 2WAY | SUCTION TEMPERATURE |
| 3WAY | DISCHARGE TEMPERATURE |
| TEMPERATURE SELECTION | ERROR CODE |
| AIR/WATER OUTLET TARGET TEMPERATURES | FCU |
| BOILER PUMP | BY PASS |
| BOILER CONTROL | FLOW SW |
| BOILER WATER OUTLET TARGET | RELAY1 |
| BOILER WATER OUTLET TEMPERATURE | RELAY2 |
| BOILER ERROR NUMBER | 4WAY |
| | HOTGAS |
| | TEMPERATURE SELECTION |
| | AIR/WATER OUTLET TARGET TEMPERATURES |
| | WARM WATER TARGET |

375

376

APPARATUS FOR CONTROLLING AN AIR CONDITIONER AND A METHOD FOR OPERATING THE SAME

CROSS-REFERENCE TO RELATED APPLICATION(S)

This application claims priority to Korean Patent Application No. 10-2012-0127474, filed on Nov. 12, 2012 in the Korean Intellectual Property Office, the disclosure of which is incorporated herein by reference.

BACKGROUND

1. Field

An apparatus for controlling an air conditioner and a method for operating the same are disclosed herein.

2. Background

Apparatuses for controlling air conditioners are known. However, they suffer from various disadvantages.

BRIEF DESCRIPTION OF THE DRAWINGS

Embodiments will be described in detail with reference to the following drawings in which like reference numerals refer to like elements, and wherein:

FIGS. 8 and 9 are exemplary diagrams each illustrating a frame on which an information display item is displayed changed according to a connection mode of a control apparatus in accordance with an embodiment; and FIGS. 10 and 11 are exemplary diagrams each illustrating a frame on which a data item is displayed changed according to a connection mode of a control apparatus in accordance with an embodiment.

DETAILED DESCRIPTION

The advantages, features, and methods for achieving those will become apparent upon referring to embodiments described later in detail together with the attached drawings. However, embodiments are not limited to the embodiments disclosed hereinafter, but may be embodied in different modes. The embodiments are provided for making a disclosure perfect and notifying a scope to persons skilled in this field of art completely, and embodiments will be defined only by scope of claims. Wherever possible, the same reference numbers will be used throughout the drawings to refer to the same or like parts.

An apparatus for controlling an air conditioner in accordance with an embodiment will be described in detail with reference to the attached drawings.

In general, a control apparatus controls a domestic appliance, such as a TV, a video device, an audio device, an air conditioner, a cable broadcasting converter, a satellite broadcasting converter, or a fan. Depending on the application, the control apparatus may remotely control various domestic appliances by wireless transmission of a control frequency or cable communication. The control apparatus may be a specialized apparatus to a particular domestic appliance, or a computer having software loaded thereon to control a particular domestic appliance.

Such a control apparatus may be applied to an air conditioner. A multi-type air conditioner used in a large-sized building, which requires a plurality of indoor units or devices, may have one outdoor unit or device connected to the plurality of indoor devices. As the plurality of indoor devices may be installed in respective rooms to air condition the rooms, an effect may be obtained that a plurality of air conditioners are installed in the building.

In general, though the multi-type air conditioner is provided with a central controller to control and monitor a state of the air conditioner in a position of a user, to enable the use to monitor temperature, an operation mode, and whether the air conditioner has something wrong with it or not. However, if the air conditioner has something wrong with it, a state of the air conditioner needs to be inspected based, not on simple state data, but rather, on various data for each unit or device of the air conditioner, for proper inspection.

Though an apparatus that accesses and inspects one of the units or devices of the air conditioner, to carry out a proper inspection of the state, shows data on each of the devices one by one, because an amount of the data is massive, there has been a problem in that it is difficult to forward the data effectively and to easily grasp a state of the data.

Figure 1:
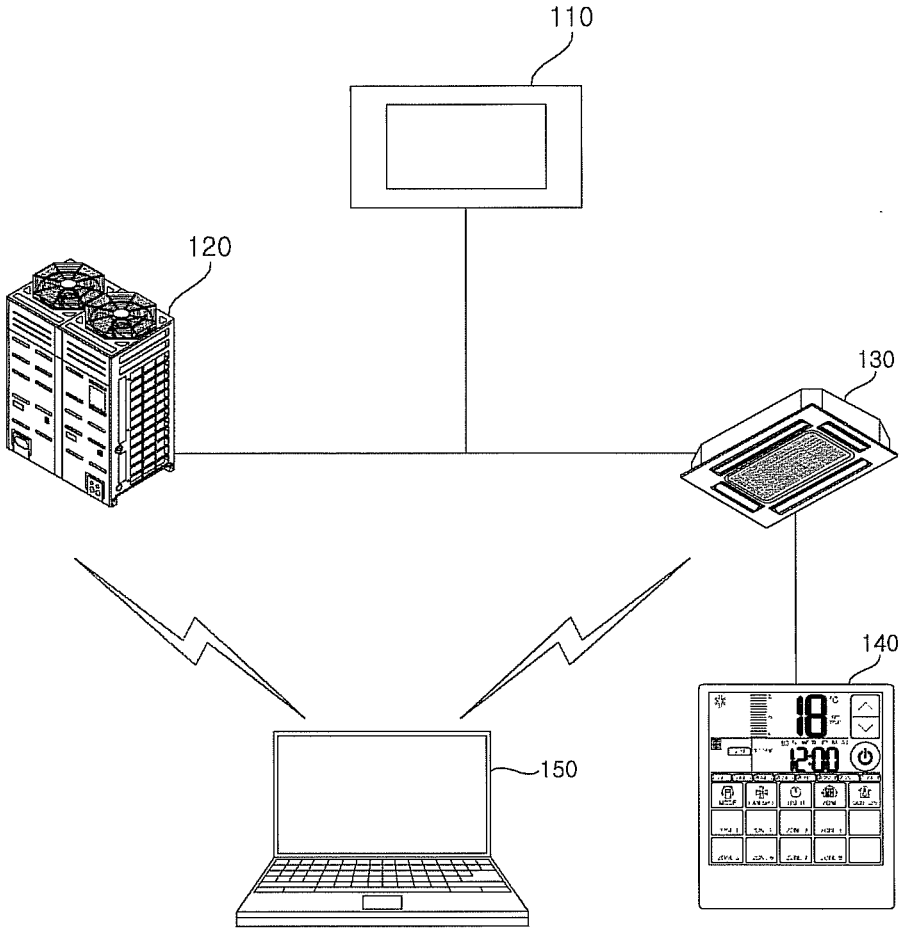
FIGS. 1 to 3 are schematic diagrams of an air conditioner system including a control apparatus in accordance with embodiments.
Figure 2A:
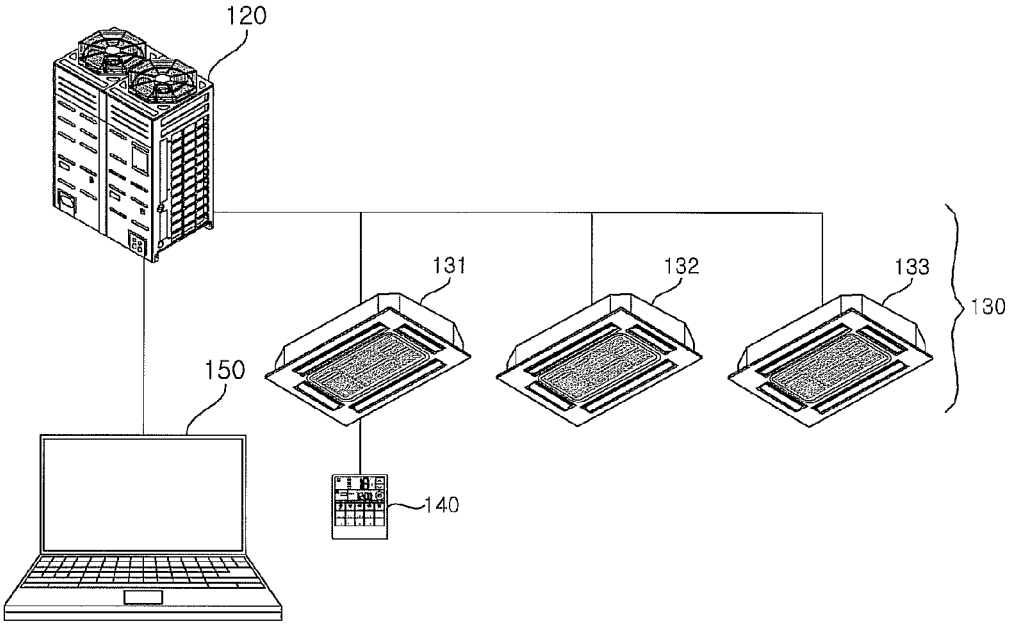
Figure 2B:
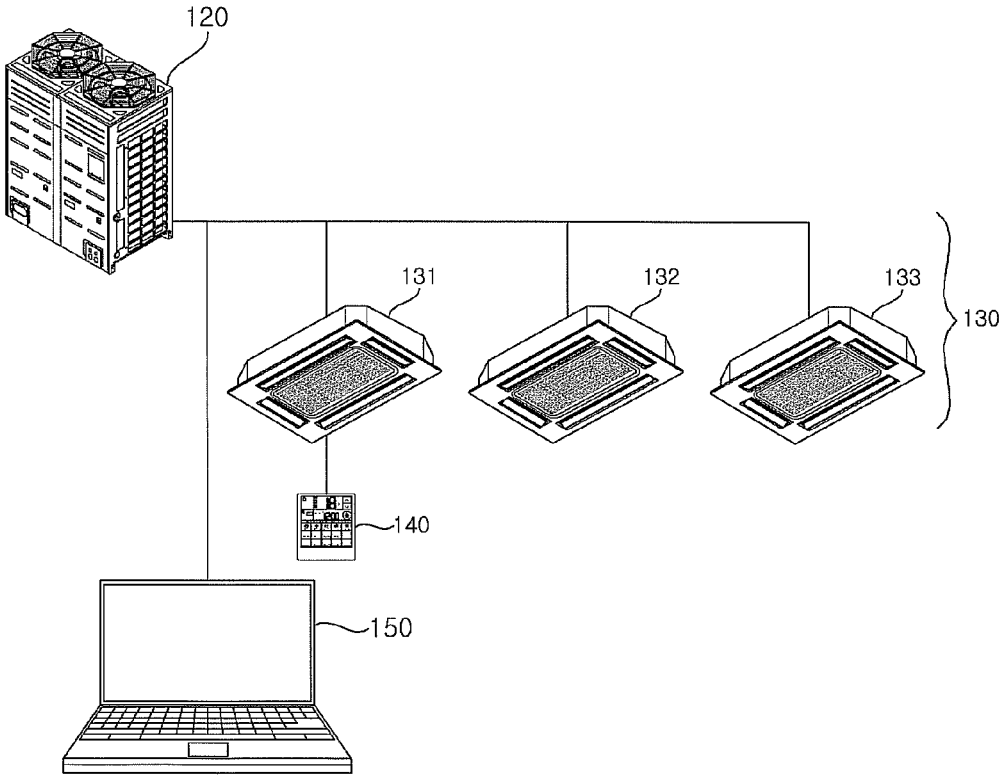
Figure 3:
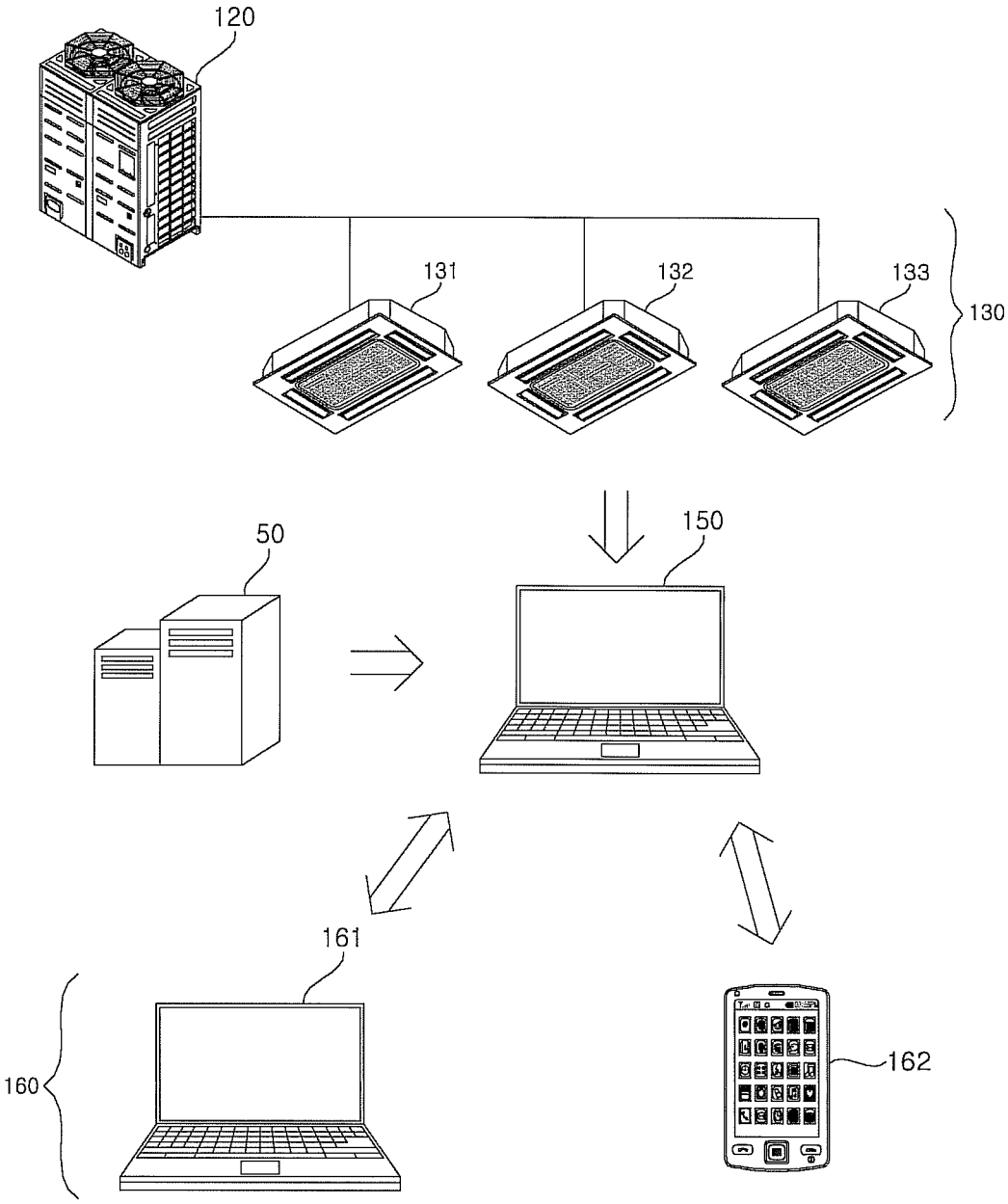

FIGS. 1 to 3 are schematic diagrams of an air conditioner system including a control apparatus in accordance with embodiments. Referring to FIG. 1, the air conditioner system in accordance with embodiments may include an indoor unit or device 130, an outdoor unit or device 120, a central controller 110, a remote controller 140, and a control apparatus 150. In addition, the indoor device and the outdoor device, the air conditioner system may also include a ventilator, a defroster, a humidifier, a heater, and a showcase.

The control apparatus 150 may be a microcomputer including software connected to the indoor device 130 or the outdoor device 120, with or without wire, to control the indoor device 130 or the outdoor device 120. The remote controller 140 may be connected to the indoor device 130 or the outdoor device 120, with or without wire, for transmission of a control signal.

The central controller 110 may be connected to the indoor device 130 and the outdoor device 120 to transmit/receive data thereto/therefrom to monitor and control operation thereof. The central controller 110 may include an input to input an order or command thereto, and an output to display control data or information.

The input of the central controller 110 may include, for example, a mechanical button, or a touch pad to sense a touch input. The output of the central controller 110 may include a device that emits light, such as a Light Emitting Diode (LED), or an Organic Light Emitting Diode (OLED).

The central controller 110 may include a microprocessor to process information, and transmit/receive a control signal for information processing. As shown in FIG. 1, the central controller 110 may be connected to the indoor device 130 and the outdoor device 120, and may communicate with the indoor device 130 and the outdoor device 120 with or without wire.

The central controller 110 may control the indoor device 130 and the outdoor device 120 individually. For example, in order to control the indoor device 130, the central controller 110 may perform a central control locking to cut off operation of the remote controller 140, which may control each of the plurality of indoor device 130. In such a case of the central control locking of the multi air conditioner system, the central controller 110 may transmit a signal to limit input to the remote controller 140, to the remote controller 140, the indoor device 130, or the outdoor device 120.

The air conditioner, being a room cooling/heating system that cools a room, or heats the room by an operation opposite to the room cooling using a repetitive operation of drawing warm air from the room, heat exchanging the warm air thus drawn with a low temperature refrigerant, and discharging the air thus heat exchanged to the room, is an apparatus that forms a series of cycles using a compressor-condenser-expansion valve-evaporator arrangement.

The air conditioner may be divided into the outdoor device 120 installed mostly outdoor, and the indoor device 130 installed mostly indoor. The outdoor device 120 may have the condenser and the compressor mounted therein, and the indoor device 130 may have the evaporator mounted therein. The outdoor device 120 and the indoor device 130 may be connected to the central controller 110 to receive a control signal. The indoor device 130 may include a plurality of indoor devices. The plurality of indoor devices 130 may be individually connected to the control apparatus 150 to receive a control signal to perform an operation corresponding thereto.

If data information is requested from or by the control apparatus 150, the outdoor device 120 may transmit the data information thus requested. Depending on contents of the request from the control apparatus 150, contents of the data information transmitted may vary. For example, the outdoor device 120 may vary the data information to be transmitted based on a requested time; however, embodiments are not so limited.

The outdoor device 120 may include a storage medium (not shown) to store the data information. The outdoor device 120 may store the data information, including operation states, periodically. In one case, the outdoor device 120 may receive a storage period, or a storage time period to store the data information from the control apparatus 150. If an error occurs, the outdoor device 120 may extend the storage time period of the data information recently stored or being stored. For example, if an error occurs, the outdoor device 120 may store the data information recently stored separate from other information. The storage medium (not shown) may include, for example, an Electronically Erasable and Programmable Read Only Memory (EEP-ROM).

The indoor device 130 may communicate with the control apparatus 150 with or without wire. The indoor device 130 may include a communication module for communication with the control apparatus 150 with or without wire.

If the data information is requested from or by the control apparatus 150, the indoor device 130 may transmit the data information thus requested. The indoor device 130 may vary contents of the data information transmitted in accordance with contents of the request from the control apparatus 150. For example, the indoor device 130 may vary the data information transmitted according to a time requested by the control apparatus 150.

The indoor device 130 may receive a control signal from the control apparatus 150. If the control signal is received from the control apparatus 150, the indoor device 130 may report completion of reception of the control signal to the control apparatus 150, for example, and this may vary based on a communication system employed by the air conditioning system.

Upon reception of the control signal, the indoor device 130 may carry out an operation corresponding thereto. The indoor device 130 may receive a storage period, or a storage time period for storing a data signal, including an operation state, from the control apparatus 150. The indoor device 130 may store the data information periodically, or if an error occurs.

If an error occurs, the indoor device 130 may extend a storage time period of the data information recently stored or being stored. The indoor device 130 may include a storage medium (not shown) for storage of the data information. The storage medium may include, for example, an Electronically Erasable and Programmable Read Only Memory EEP-ROM. For example, the indoor device 130 may store the data information periodically, and, if an error occurs, the indoor device 130 may store the data information recently stored separate from other information, for example.

The data information may include the operation state of the indoor device 130 or the outdoor device 120. For example, the data information may include, for example, an air temperature, a condensing temperature, an evaporation temperature, a discharge temperature, and a heat exchanger temperature, as well as any other information related to the operation of the indoor device 130 or the outdoor device 120.

The indoor device 130 may transmit the data information including the operation state to the control apparatus 150. Whether the indoor device 130 is turned on or off, whether the operation state of the indoor device 130 changes, or if an error occurs, the indoor device 130 may transmit data information indicating such to the control apparatus 150. If an event takes place, or at fixed intervals, the indoor device 130 may communicate with the control apparatus 150.

The remote controller 140 may control the indoor device 130 with or without wire. The operation of the remote controller 140 may be limited by the central controller 110. The remote controller 140 may control the operation state of the indoor device 130. The indoor device 130 may control one or more of the plurality of indoor device 130; however, embodiments are not so limited.

The air conditioner system may include the control apparatus 150. The control apparatus 150 may control the indoor device 130 and the outdoor device 120. The control apparatus 150 may change an operation mode of the indoor device 130. The operation mode may include modes of room cooling, dehumidifying, air cleaning, or room heating.

The control apparatus 150 may receive detailed cycle data from the air conditioner in real time to enable problem diagnosis on the air conditioner and display the cycle data on a screen.

The control apparatus 150 may display the data information received from the indoor device 130, the outdoor device 120, or another control device (not shown). The control apparatus 150 may display the data information in various modes. For example, the control apparatus 150 may display the data information in a mode of setting forth numerical values, or displaying the operation state of a device to be controlled in a time series of images, or a graph.

If there is an input intended to determine the operation state of a domestic appliance the control apparatus 150 is to control, the control apparatus 150 may transmit to the domestic appliance a signal for requesting the data information. The control apparatus 150 may select the outdoor device 120 or the indoor device 130 for which data information is intended to be determined.

If the data information is displayed in characters, such as numerals, the control apparatus 150 may display the data information on the indoor device 130, the data information on the outdoor device 120, and valve information on a pipeline that connects the indoor device 130 to the outdoor device 120. Depending on embodiments, if the valve information is displayed, the control apparatus 150 may display opened or closed valve information in color or with graphics. For example, the control apparatus 150 may display an opened valve in blue, a closed valve in gray, or display forms of the opened valve and the closed valve with graphics; however, colors or graphics are not limited to those described above.

If the data information is to be displayed using a graph, the control apparatus 150 may select a data value associated with a graph. For example, the control apparatus 150 may display a plurality of operation information buttons on a top side of a region where a graph is displayed, and if any one of the plurality of operation information buttons is selected, a data value matched to the operation information button thus selected may be displayed in the graph. For example, the plurality of operation information buttons may correspond to a pressure of the outdoor device 120 or the indoor device 130, a temperature of the outdoor device 120 or the indoor device 130, a discharge pressure from the compressor, an EEV opening, and a fan speed, respectively.

If the data information is displayed in time series images, the control apparatus 150 may select the outdoor device 120 or the indoor device 130 intended to display. If the control apparatus 150 selects one of a plurality of outdoor devices 120 intended to be displayed, the control apparatus 150 may select one of the plurality of indoor devices 130 connected to the outdoor device 120 thus selected.

If the outdoor device 120 and the indoor device 130 are selected, the control apparatus 150 may receive the data information including the operation state of the indoor device 130 thus selected, and a connection state of the outdoor device 120 thus selected and the indoor device 130 thus selected. The connection state may include, for example, a pipeline connection state, a flow in the pipeline, and on/off of a valve.

The control apparatus 150 may display the operation state of the outdoor device 120 and the indoor device 130 thus selected in a time series, such as changes in a picture or changes in color. The control apparatus 150 may display a state of the pipeline that connects the outdoor device 120 and the indoor device 130 thus selected or a state of the valve.

The control apparatus 150 may display the state of the pipeline that connects the outdoor device 120 and the indoor device 130 thus selected with the change in color according to whether there is a flow in the pipeline or not, or according to a flow direction. The control apparatus 150 may display turn a on/off of the valve mounted to or in the pipeline connected between the outdoor device 120 and the indoor device 130 a picture.

The control apparatus 150 may determine the operation state of the indoor device 130 or the outdoor device 120 in real time. If the control apparatus 150 determines the operation state of the indoor device 130 or the outdoor device 120 in real time, the control apparatus 150 may receive the data information and display the data information thus received in real time.

Referring to FIGS. 2A-2B, a connected position of the control apparatus 150 may be varied. That is, referring to FIG. 2A, the control apparatus 150 may be connected to the outdoor device 120. If connected to the outdoor device 120, the control apparatus 150 may receive data stored at or in the outdoor device 120 to determine a state of the air conditioner. In this case, all data may be received through the outdoor device 120.

Alternatively, referring to FIG. 2B, the control apparatus 150 may be connected to a communication line connected to a plurality of indoor devices 131 to 133, or depending on the case, may be connected to one of the indoor devices 131 to 133. The control apparatus 150 connected to the communication line connected to the plurality of indoor devices 131 to 133 may receive, not only the data stored at or in a particular device, but also the data transmitted/received among the plurality of indoor devices 131 to 133 through the communication line. For example, as the control apparatus 150 may receive and display the data transmitted/received between the indoor device 130 and the central controller 110, the control apparatus 150 may also receive and display a control flow of the central controller 110.

As such, depending on modes of connection of the control apparatus 150, that is, depending on a connection of the control apparatus 150 to the outdoor device or the communication line of the indoor device, the data the control apparatus 150 receives and displays may be vary.

Referring to FIG. 3, the air conditioner system may include a plurality of control apparatuses 150 and 160. The plurality of control apparatuses 150 and 160 may include a first control apparatus 150 connected to the air conditioner to collect data, and second control apparatuses 161 and 162 that communicate with the first control apparatus 150 to receive information on the air conditioner. The plurality of control apparatuses 150 and 160 may transmit/receive information in or using a variety of communication systems, and may display the data information in different languages.

The first control apparatus 150 may store and accumulate the received data and may access to a separate data server 50, or may request data, if necessary.

Figure 4A:
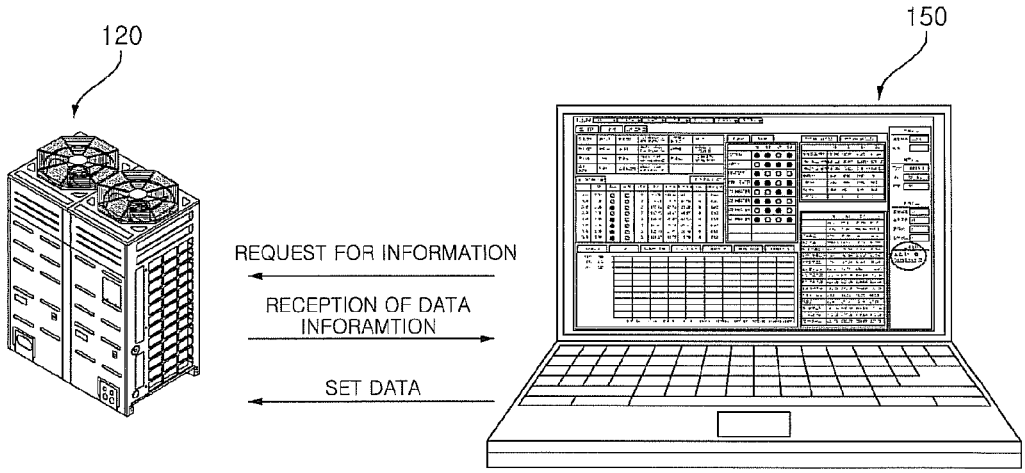
FIGS. 4A-4B are schematic diagrams illustrating data flow between a control apparatus in accordance with an embodiment and an outdoor device of an air conditioner.
Figure 4B:
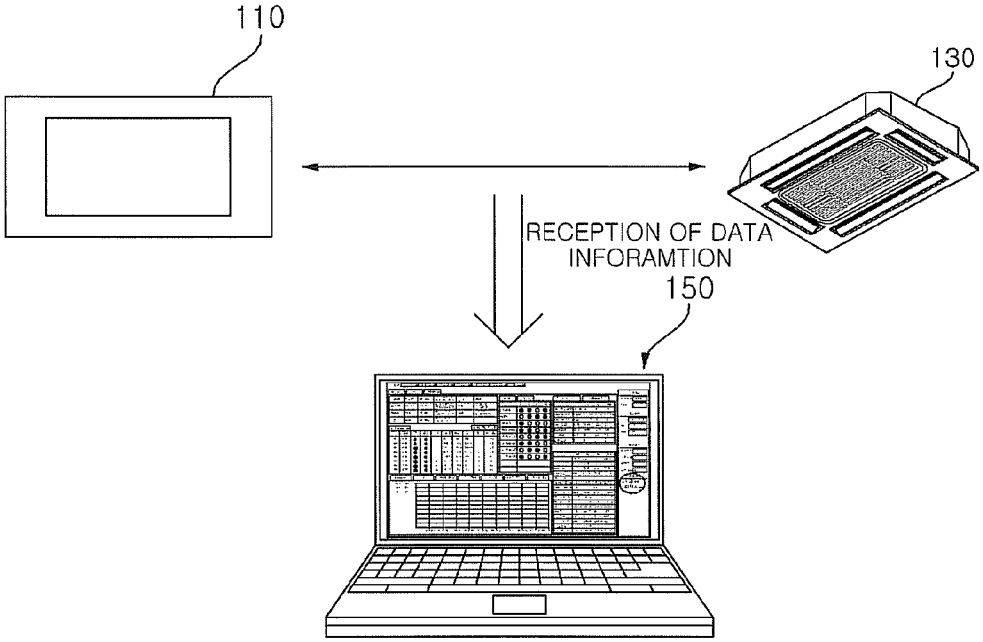

FIGS. 4A-4B are schematic diagrams illustrating data flow between a control apparatus in accordance with an embodiment and an outdoor device of an air conditioner. Referring to FIGS. 4A-4B, the control apparatus 150 may be connected to the outdoor device 120 to request data, and the outdoor device 120 may transmit the information data on the air conditioner to the control apparatus 150 as requested. In such a case, as described above, the control apparatus 150 may be connected to a communication line of the plurality of indoor devices 131 to 133, and may receive the control signal exchanged between the plurality of indoor devices 131 to 133 and the central controller 110 to collect information on the air conditioner.

When the data information is requested from the control apparatus 150, though the indoor device 120 or the outdoor device 130 may transmit the data information to the control apparatus 150, the data transmission is not so limited, that is, the data information may be transmitted to the indoor device 120 or the outdoor device 130 at particular periods or intervals.

Figure 5:
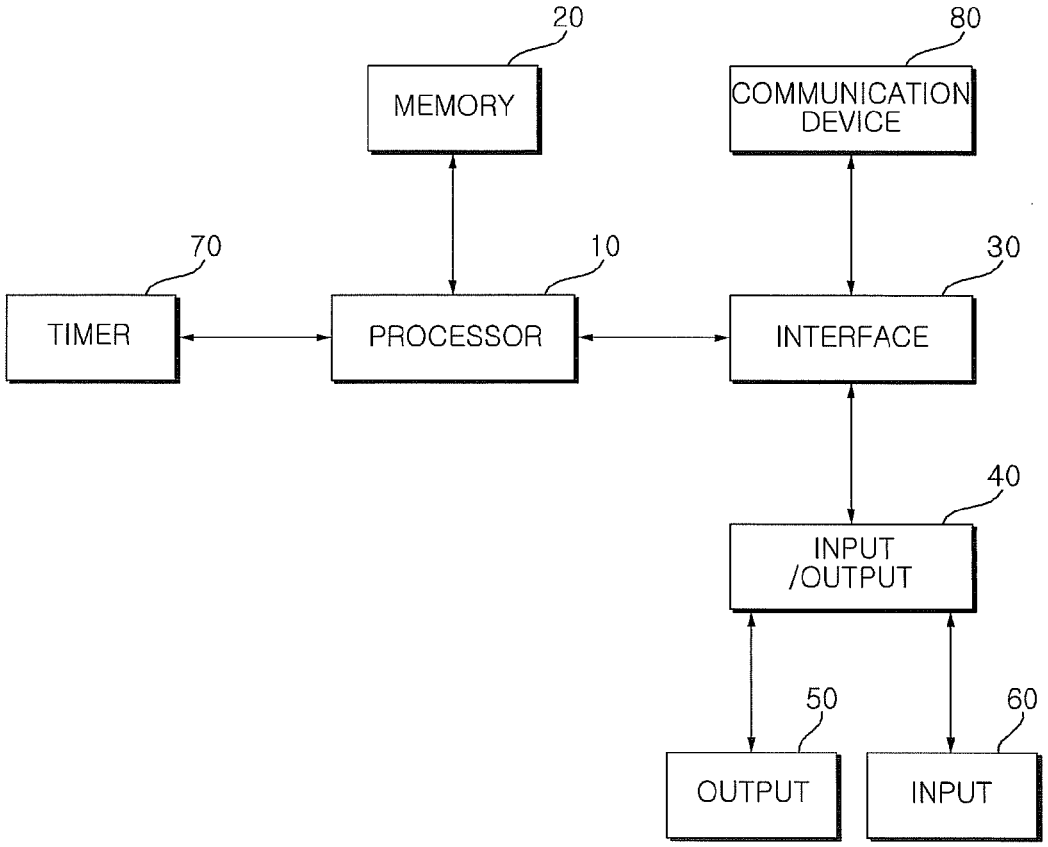
FIG. 5 is a block diagram of a control apparatus in accordance with an embodiment.

FIG. 5 is a block diagram of a control apparatus in accordance with an embodiment. Referring to FIG. 5, the control apparatus 150 may include a processor 10 to process various signals and carry out calculations, a memory 20 to store programs and data in association with the processor 10, and an interface 30 to connect to peripheral devices related to input or output to/from the processor 10. The control apparatus 150 may also include a timer 70, a communication device 80, and an input/output 40, including an output 50 and an input 60.

The processor 10 may carry out different functions for the control apparatus 150, and may run or carry out different software programs and/or sets of command languages stored in the memory 20 to process data. The processor 10 may process signals based on information stored in the memory 20.

For example, the processor 10 may display data stored in the memory 20 on the output 50, or may carry out programs stored in the memory 20. The processor 10 may carry out the programs by calculating a time in association to the timer 70.

The memory 20 may include at least one magnetic disk storage device, a flash memory device, or other non-volatile memory, such as a non-volatile solid memory device. However, embodiments are not so limited, and may include a readable storage medium. For example, the memory 20 may include an Electronically Erasable and Programmable Read Only Memory (EPP-ROM). The EEP-ROM may have information written or erased by the processor 10 during operation of the processor 10. The EEP-ROM may be a memory device, which may maintain information stored therein without being erased even if power to the control apparatus 150 is turned off to cut off power supply.

The memory 20 may store different programs and data stored therein in association with the processor 10. The programs the memory 20 has stored therein may be run by the processor 10.

If there is an input to the input apparatus 60 to determine the operation state of a domestic appliance the control apparatus 150 controls, the processor 10 may control the communication device 80 to receive the data information, which is operation information of the domestic appliance and to display the data thus received/transmitted. In such a case, the data being displayed on a screen may be displayed in time series images or characters.

If one outdoor device 120 is selected to be inspected through the input 60, the processor 10 may receive data information from the outdoor device 130 thus selected, and from one of the plurality of indoor devices connected to the outdoor device thus selected. In this case, the information may include the operation state of the indoor device thus selected and connection states of the outdoor device thus selected and the indoor device thus selected.

The processor 10 may receive information, and may display the operation states of the outdoor device thus selected and the indoor device thus selected, and the connection states thereof. The processor 10 may further receive information on the outdoor device or the indoor device in real time, and may display the information in images or characters in real time through the output 50. In such a case, the processor 10 may display the received data in a set language, or in a language other than a language stored therein.

The processor 10 may set a data storage time period or storage period of the outdoor device or the indoor device, and transmit the same to the outdoor device and the indoor device. The indoor device and the outdoor device may store the data according to the setting, and erase the data at a length of a storage time if the time period has passed.

In displaying the information on the outdoor device and the indoor device, the processor 10 may display data in real time or change the data in an order of times in succession if the data is produced before a fixed time. In such a case, the processor may display information regarding components of the indoor device or the outdoor device, for example, valve, pressure, and temperature of the pipeline, and states of the heat exchanger and the compressor in images or moving images, and depending on the case, the operation state, in different colors.

For example, a fan operation state of the indoor device may be displayed in or as a rotating image of rotation blades, and a rotation speed of the fan may be displayed in or as a numerical value or a color. If the pipeline has a flow of a fluid therein, the flow may be displayed divided into a blue color and a red color depending on a temperature thereof, and a valve on/off may be displayed in a valve form and a color change, through the output 50.

If the processor 10 is to display the data thus received, the processor 10 may display the data, re-producing the data according to time, while controlling a display speed thereof. That is, in displaying changes in the information with time, the display speed may be controlled according to passing time.

The interface 30 may connect the input and output peripheral devices to the processor 10 and the memory 20. In such a case, the processor 10, the memory 20, or the interface 30 may be embodied on a single chip, for example, or they may be embodied on individual chips.

The timer 70 may check time. The processor 10 may determine whether a predetermined time has passed using the timer 70 to carry out a control. For example, the timer 70 may calculate a re-producing rate of the images; however, embodiments are not so limited, as there may be different embodiments.

The input/output 40 may connect peripheral devices, such as the output 50 and the input 60, to the interface 30 to relay and control input/output of data. Depending on the case, the input/output 40 may include an input/output controller (not shown) to control the output 50 and/or the input 60.

The output 50 may include a speaker that emits sound, or a display that emits light to make a visual display. The input 60 may include means to receive an external input, such as a physical button, a dial, a slider switch, or a click wheel, for example. The output 50 may include at least one of a Light Emitting Polymer Display (LPD), a Liquid Crystal Display (LCD), a Thin Film Transistor-Liquid Crystal Display (TFT-LCD), a Organic Light-emitting Diode (OLED), a flexible display, or 3D display; however, embodiments are not so limited, and may include a variety of systems.

The output 50 may display information for controlling a component device to which the control apparatus 150 is connected. If the control apparatus 150 is applied to an air conditioner system, the output 50 may display information required for air conditioning. For example, the output 50 may display operation modes of the air conditioner, such as room cooling, room heating, dehumidifying, or air cleaning of the air conditioner, and may display a room temperature, a wind direction, and the presence of a heat source in a room.

The output 50 may be a touch sensing touch screen. In this case, the output 50 may be fabricated as one unit with the input. The touch sensing touch screen may display a visual output to a user, and may receive input from the user by sensing a touch. The visual output may include, for example, graphics, a text, an icon, a video, or a combination thereof. If the output 50 includes the touch sensing touch screen, buttons on the input 60 discussed below may be replaced with user interfaces (visual buttons) displayed on the touch screen.

The input 60 may include, for example, at least one button, or switch, and depending on the case, may include a touch pad that perceives an input by pressure or static electricity. The input 60 and the output 50 may be controlled by an input/output controller (not shown) in the input/output 40. The input 60 and the output 50 may include a plurality of interfaces or buttons corresponding to instruction words to carry out programs stored in the memory 20, or functions discussed above.

The communication device 80 may be connected to the indoor device 130, the outdoor device 120, and the interface 30 to receive a control signal from the interface 30 and transmit the control signal to the indoor device 130 or the outdoor device 120, and receive operation states from the indoor device 130 or the outdoor device 120. If the communication device 80 wirelessly communicates with the indoor device 130 or the outdoor device 120, the communication 80 may include a RF (Radio Frequency) circuit. The communication device 80 may transmit/receive the RF signal which is an electro-magnetic signal. The RF circuit may convert an electric signal to an electro-magnetic signal, and may communicate with a communication network and other communication devices with the electro-magnetic signal.

For example, the RF circuit may include an antenna system, an RF transceiver, at least one amplifier, a tuner, at least one oscillator, a digital signal processor, a CODEC chip set, and a memory, and may include known circuits to carry out functions. Moreover, the communication device may use a wireless communication system selected from, but not limited to, Bluetooth, Radio Frequency Identification, IrDA (Infrared Data Association), Ultra Wideband, ZigBee, and Wi-Fi.

The communication device 80 may receive a signal from the processor 10 through the interface 30. If the communication device 80 receives a control signal from the interface 30, the communication device 80 may modulate the control signal and transmit the signal thus modulated to the indoor device 130 or the outdoor device 120.

Figure 6:
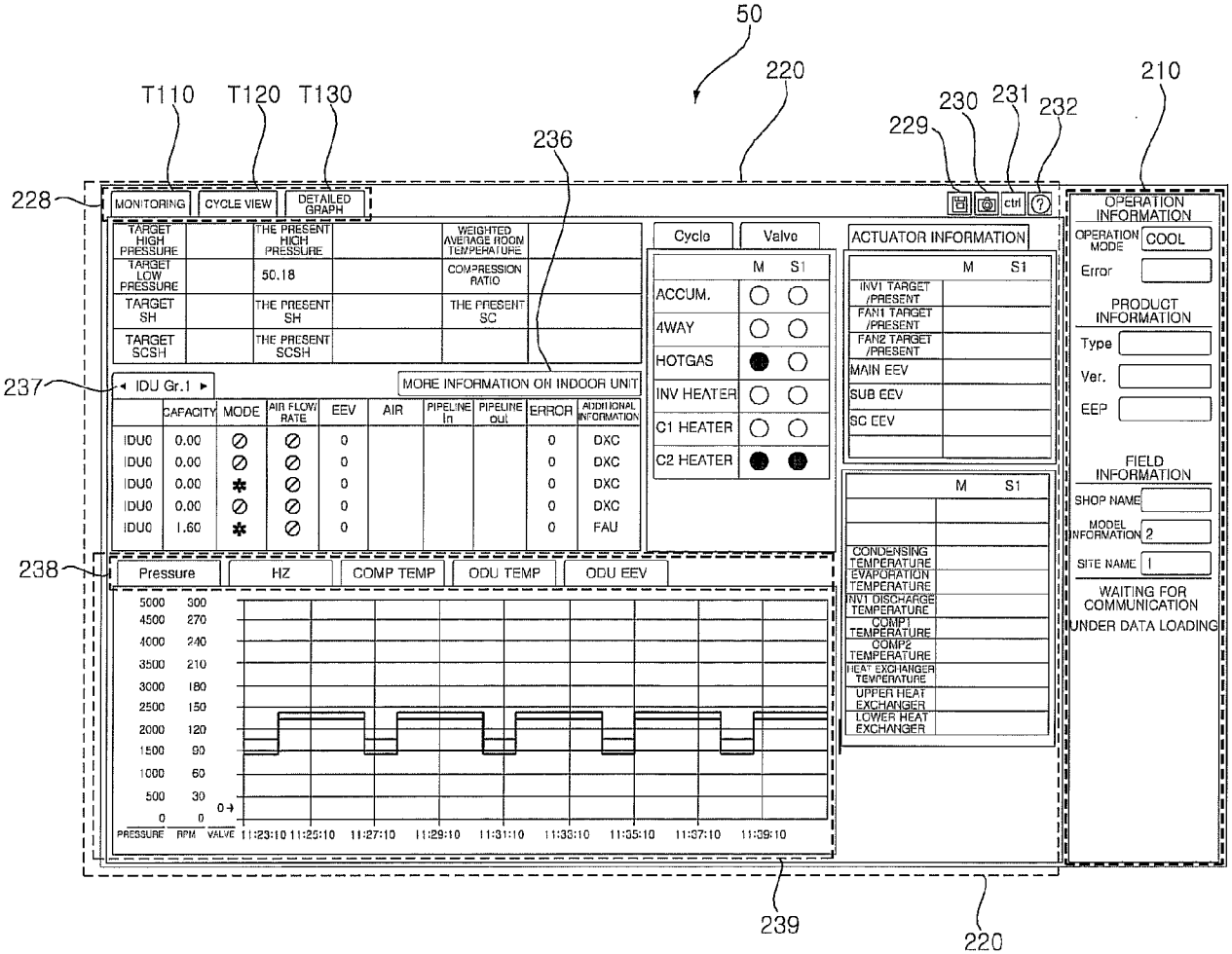
FIG. 6 is an exemplary view illustrating a frame for monitoring an air conditioner displayed on a control apparatus in accordance with an embodiment.

FIG. 6 is an exemplary view illustrating a frame for monitoring an air conditioner displayed on a control apparatus in accordance with an embodiment. The control apparatus 150 may receive information on component devices including the outdoor device and the indoor device and forward the information through the output 50.

In such a case, referring to FIG. 6, the output 50 may display information on a plurality of the component devices connected to the control apparatus 150, including the outdoor device and the indoor device.

The output 50 may display the information on the component devices on a frame, dividing the frame into a monitoring window 220 and an information display window 210. The monitoring window 220 may include an additional menu button 228 to display, in addition to a monitoring button T110, a cycle view button T120, and a detailed graph button T130. If these respective buttons are selected, a cycle view window and a detailed graph window may be displayed on the frame together with additional menus.

Further, the monitoring window 220 may have a plurality of function buttons displayed thereon. The function buttons may be, for example, a storage button 229, a still shot button 230, a control button 231, and/or a help button 232.

When the storage button 229 is selected, a plurality of data presently displayed by the output 50 may be stored, together with time information. The still shot button 230 may store data presently displayed on the monitoring window 220 and the information display window 210 with the appearance of the frame in a still shot image.

When the control button 231 is selected, a storage period of the data thus monitored, and a storage time period of the data for one storage period may be set. In this case, selection of a button is not required, rather, the data may be stored, periodically. A change in language displayed on the monitoring window 220 and the information display window 210 is possible. Further, frame settings may be corrected, and a size of image stored when a still shot is selected may be set. Moreover, when the control button 231 is selected, a control setting for the plurality of component devices may be possible.

The monitoring window 220 may have individual information and group information on one of the plurality of component devices displayed thereon, and information on a particular device selected at the monitoring window 220 may be displayed on the information display window 210.

The monitoring window 220 may have the plurality of component devices sorted, and information on the plurality of component devices sorted in or corresponding to a plurality of the buttons or taps, such that, if one of the buttons is selected, information on one of the plurality of component devices may be displayed on the frame. The monitoring window 220 may be divided into a plurality of regions to display data in the plurality of regions different from one another. The monitoring window 220 may display basic operation information, group, and individual device information for the plurality of component devices, cycle information, measured data values, and an operation graph window 239 for each device.

In the basic operation information, a control target value on a pressure or a temperature of the presently displayed device, for example, the air conditioner, and data being measured presently may be displayed. In the group and individual device information, a group selection button 237 may be provided to enable selection of a group intended to be displayed, and information on an individual device in the group may be displayed in a list. If there are contents in an additional information item, an additional information button 236 may additionally display information on a special indoor device on an additional window.

In the cycle and measured data information, whether each function of a master outdoor device and slave outdoor devices is operating or not may be displayed, and measured values thereof may be displayed. Further, information on the fan and the valve, and information on a discharge temperature of the compressor, a condensing temperature and evaporation temperature of the heat exchangers may be displayed.

For example, the target pressure, the present pressure, a compression ratio, a room temperature, operation of each element, whether the valve of the outdoor device 120 is in operation or not may be displayed, and a pressure of the outdoor device 120 or the indoor device 130, a temperature of the outdoor device 120 or the indoor device 130, and a discharge pressure of the compressor, an EEV opening, and a fan speed may be displayed.

In the operation graph window 239, the pressure of the compressor, an operation frequency, a compressor temperature, a temperature of the outdoor device, operation of an outdoor device valve may be selected with respective selection buttons 238, to display a graph on each item of the device thus selected. The operation graph window 239 may display a plurality of pieces of information divided into colors different from one another, or thicknesses or line forms different from one another. Also, the information displayed on the operation graph window 239 may be displayed when the detailed graph button T130 is selected, but may be displayed in more detail.

In the information display window 210, if one of the devices displayed in the group information is selected, an operation mode, whether an error occurs or not, a kind of error, and product information on a product type or version of the device may be displayed, together with information on a position of the device thus selected. In the information display window 210, a communication state with the device thus selected may also be displayed.

Figure 7:
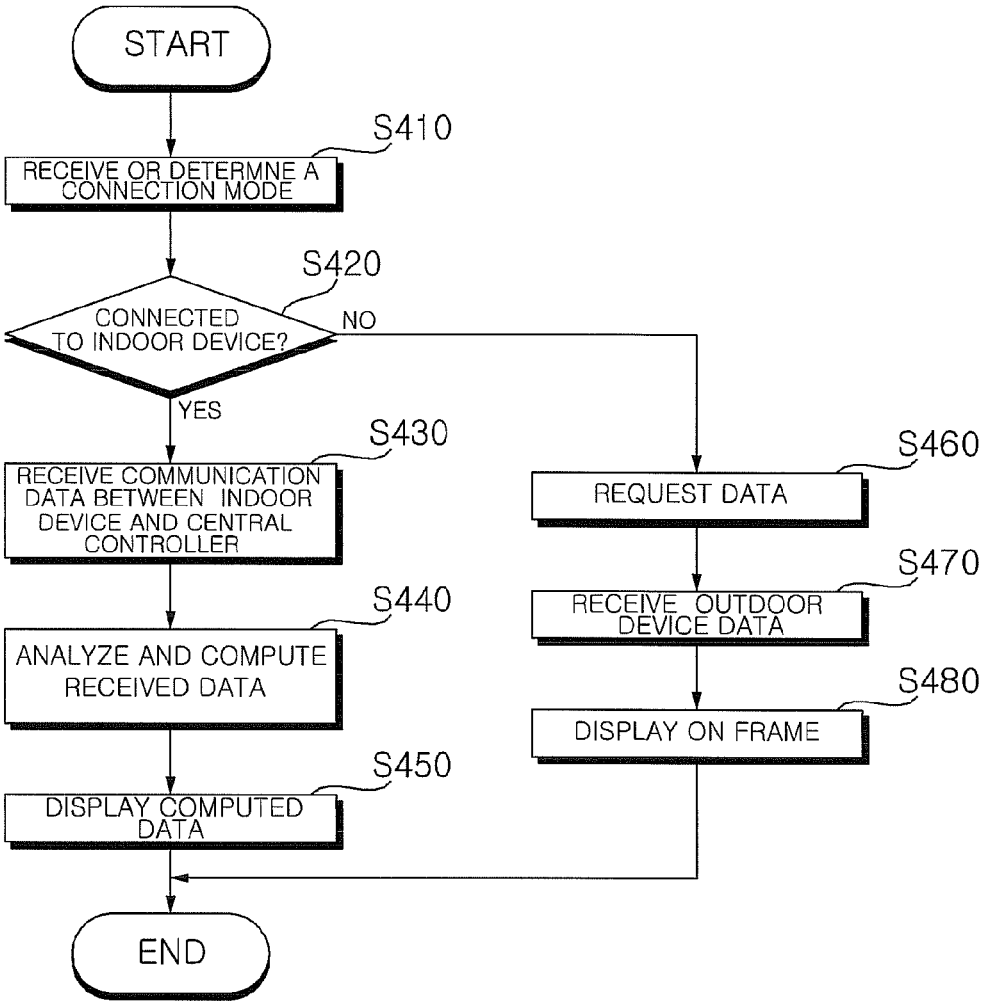
FIG. 7 is a flow chart of a method for operating a control apparatus for an air conditioner in accordance with an embodiment.

FIG. 7 is a flow chart of a method for operating a control apparatus for an air conditioner in accordance with an embodiment. As discussed above with respect to FIG. 2, the control apparatus 150 may be connected to the outdoor device 120, the indoor device 130, or the communication line of the indoor device 130. The processor 10 of the control apparatus 150 may display data on the air conditioner displayed on the output 50 different from one another according to a connection mode of the control apparatus 150. In this case, as the data received is according to the connection mode, the data to be displayed may also be different.

The control apparatus 150 may be connected to the air conditioner through the interface 30, and depending on the connection mode, the control apparatus 150 may receive data through the communication device 80 connected to the interface 30, or through the input/output 40. Alternatively, the control apparatus 150 may receive data through an additional connection device.

Referring to FIG. 7, as the control apparatus 150 may be connected to the air conditioner, the connection apparatus 150 may receive or determine a connection mode, in step S410. The connection mode may be received by the input 60, or received automatically in response to a connection sensing signal of the interface 30, and the connection mode may be determined matched or corresponding to a kind of port, or received data.

The processor 10 may determine whether the control apparatus 150 is connected to the indoor device 130 or not, according to the connection mode the processor 10 receives or determines, in step S420. The connection to the indoor device 130 may include a case in which the control apparatus 150 is connected to the communication line of the indoor device 130, as discussed above with respect to FIG. 2B, or the control apparatus 150 is connected to the indoor device 130, directly.

If the control apparatus 150 is connected to the indoor device 130, the control apparatus 150 may receive communication data transmitted or exchanged between the indoor device 130 and the central controller 110 through the interface 30, in step S430. The data thus received may be stored in the memory 20, and applied to the processor 10. The processor 10 may analyze the data thus received, subject the data to computation, in step S440, and display the data in a monitoring frame or the cycle view frame of the output 50, in step S450.

If the control apparatus 150 is connected to the outdoor device 120, the processor 10 may request data for the outdoor device 120 of the air conditioner through the interface 30, in step S460. If the data is transmitted from the indoor device 130 as requested, the control apparatus may receive the data thus transmitted, in step S470, and the processor 10 may analyze the data thus received and subject the data to computation, and display the data on the monitoring frame or the cycle view frame of the output 50, in step S480. Depending on the connection mode, kinds of the data forwarded to the monitoring frame or the cycle view frame may be displayed different from one another.

FIGS. 8 and 9 are exemplary diagrams each illustrating a frame on or in which an information display item is displayed changed according to a connection mode of a control apparatus in accordance with an embodiment. FIG. 8 is an exemplary diagram illustrating a frame when the control apparatus is connected to an outdoor device, and FIG. 9 is an exemplary diagram illustrating a frame when the control apparatus is connected to an indoor device or a communication line.

Depending on the connection mode, the control apparatus 150 may display the data displayed on the frame different from one another according to the connection mode. As modes of reception of the data are different from one another according to the connection mode, making the kinds of the data thus received different from one another, the data may also be displayed different from one another.

If the control apparatus 150 is connected to the outdoor device 120, the control apparatus 150 may receive the data on the air conditioner through the outdoor device 120 and display the data thus received. Referring to FIG. 8, the data displayed on the output 50 may be, for example, data 362 on or for a first group 361 of the distributor having data on pipelines 1, 2, 3 and 4, an electronic expansion valve, a liquid tube, suction to the pipeline, discharge from the pipeline, and additional information. Also, the data displayed on the output 50 may include data 363 on a result of a search for the indoor devices connected to the distributor, a number of the indoor devices found, a number of the indoor devices registered, a search state, and whether operable or not.

If the control apparatus 150 is connected to the indoor device 130, or to the communication line of the indoor device 130 to the outdoor device 130, the control apparatus 150 may receive the communication data transmitted/received between each of the component devices of the air conditioner, and display the data. In this case, the processor 10 may analyze the communication data, determine the operation state of each of the devices, and display the data changing the data according to a control setting by the central controller. As the communication data thus received may include a control order making the communication data different from actual data, the processor 10 may change the data to make the data easy to view, or display the data subjecting the data to computation according to the control order.

Referring to FIG. 9, the data displayed on the output 50 may be, for example, data 366 on or for a first group 365 of the distributor having data on pipelines 1, 2, 3 and 4, an electronic expansion valve, a liquid tube, suction to the pipeline, discharge from the pipeline, and additional information. Also, the data displayed on the output 50 may include data 367 on a result of a search for the indoor devices connected to the distributor, a number of the indoor devices found, a number of the indoor devices registered, information on each of the outdoor devices, a search state, whether operable or not, and error information. Though information on the pipeline and the valve in a case in which the control apparatus is connected to the outdoor device may be the same as a case in which the control apparatus is connected to the indoor device, information on the indoor device connected to the distributor may be recognized as they are displayed different from each other. If the control apparatus is connected to the indoor device, as the control apparatus receives and displays the communication data transmitted/received through the communication line, the control apparatus may additionally receive and display information on each of the indoor devices.

FIGS. 10 and 11 are exemplary diagrams each illustrating a frame on or in which a data item is displayed changed according to a connection mode of a control apparatus in accordance with an embodiment. FIG. 10 is an exemplary diagram illustrating a frame when the control apparatus is connected to an outdoor device, and FIG. 11 is an exemplary diagram illustrating a frame when the control apparatus is connected to an outdoor device.

Items of data displayed on the frame may be different from one another according to the connection mode of the control apparatus 150. More particularly, in the case of a special indoor device, the items of the data displayed on the frame may be different from one another according to the connection mode of the control apparatus 150.

For example, referring to FIG. 10, if the control apparatus 150 is connected to the indoor device 130, in the case of a special indoor device WHU 371, the data displayed on the frame may be an indoor device number, a water pump, a warm water temperature mode, a warm water temperature, a target warm water, an inlet water temperature, an outlet water temperature, a temperature difference, a heater mode, a heater outlet water temperature, FCU, bypass, relay 1 and 2, a two-way valve, and a three way valve. In the case of a special indoor device CASCADE 372, the data displayed on the frame may be an indoor device number, a water pump, a warm water mode, a heater mode, a heat sink temperature, a high pressure, a low pressure, a compressor target value, a compressor present value, a compressor phase voltage, a compressor phase current, an electronic expansion valve EEV, an inlet water temperature, an outlet water temperature, a suction temperature, a discharge temperature, an error code, FCU, bypass, a flow switch, relays 1, and 2, a four-way valve, and hot gas.

Referring to FIG. 11, if the control apparatus 150 is connected to the indoor device or the communication line, in the case of a special indoor device WHU 373, the data displayed on the frame may be an indoor device number, a water pump, a warm water temperature mode, a target warm water, a warm water temperature, an inlet water temperature, an outlet water temperature, a temperature difference, a heater mode, a heater outlet water temperature, FCU, bypass, relays 1 and 2, a two-way valve, and a three way valve, as well as temperature selection, air/outlet water target temperatures, a boiler pump, boiler control, a boiler water outlet target, a boiler outlet water temperature, and a boiler error number, additionally (375). In the case of a special indoor device CASCADE 374, the data displayed on the frame may be an indoor device number, a water pump, a warm water mode, a heater mode, a heat sink temperature, a high pressure, a low pressure, a compressor target value, a compressor present value, a compressor phase voltage, a compressor phase current, an electronic expansion valve EEV, an inlet water temperature, an outlet water temperature, a suction temperature, a discharge temperature, an error code, FCU, bypass, a flow switch, relays 1, and 2, a four-way valve, and hot gas, as well as temperature selection, air/outlet water target temperature, and a warm water target value, additionally. The additional information 375 and 376 may be extracted from central controller side communication data.

In such a case, if the control apparatus is connected to the indoor device, besides the information stored in the indoor device, as the control apparatus may additionally receive data computable based on the communication data received from the central controller, as discussed above, when the control apparatus is connected to the indoor device, data may be additionally displayed.

Accordingly, as the apparatus for controlling an air conditioner and the method for operating the same according to embodiments displays data different from one another according to the connection mode, if the user changes the connection mode as required, the user may be provided with different pieces of information on the air conditioner.

Embodiments disclosed herein provide an apparatus for controlling an air conditioner and a method for operating the same, which enables easy notice or recognition of information on an air conditioner based on data received from the air conditioner, and more particularly, displays information changing with a position of a control apparatus connected thereto.

Embodiments disclosed herein provide a control apparatus connected to one of a plurality of equipped apparatuses to monitor and control the plurality of equipped apparatuses, to receive a detailed cycle data which enables trouble diagnosis on the plurality of equipped apparatuses from the equipped apparatus connected thereto thus in real time, displaying the cycle data on the plurality of equipped apparatuses on a frame, and displaying information on the plurality of equipped apparatuses different from one another according to the connection mode of kinds and connection positions of the plurality of equipped apparatuses connected thus.

Embodiments disclosed herein provide a method for operating a control apparatus that may include sensing a kind of equipped apparatuses or a connection mode, if the control apparatus is connected to a network of a plurality of equipped apparatuses, receiving a data matched to the kind of equipped apparatuses connected thus, or the connection mode, and producing the data received thus to a frame. If the control apparatus is connected to one of the plurality of equipped apparatuses, the control apparatus may request the equipped apparatus for a data, and receives the data, and, if the control apparatus is connected to one of communication lines in the network, the control apparatus receives a communication data between a central controller and the equipped apparatuses.

The apparatus for controlling an air conditioner and the method for operating the same may store and manage data received from the air conditioner, and make a mode of reception of the data from the air conditioner different from one another matching to the connection mode of a kind and a position of the apparatus to which the control apparatus is connected, making the data received thus different from one another according to the connection mode, thereby having an advantage of permitting to display various data easily to improve user's convenience significantly by producing the data of the air conditioner to the frame different from one another.

Although the apparatus for controlling an air conditioner and the method for operating the same according to embodiments has been described with reference to the illustrated drawings, it will be apparent to those skilled in the art that embodiments are not intended to be limited to the above-described embodiments and drawings, but various changes or modifications may be made therein without departing from the scope and the technical sprit.

This application relates to U.S. application Ser. Nos. 14/077,417and 14/077,428, both filed on Nov. 12, 2013 which are hereby incorporated by reference in their entirety. Further, one of ordinary skill in the art will recognize that features disclosed in these above-noted applications may be combined in any combination with features disclosed herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An apparatus for controlling an air conditioner, the apparatus comprising:

a control apparatus in communication with at least one of a plurality of component devices of the air conditioner to monitor and control the plurality of component devices, wherein the control apparatus receives cycle data that enables problem diagnosis on the plurality of component devices from the plurality of component devices, in real time, and displays the cycle data on a frame on an output, wherein the control apparatus displays the cycle data for the plurality of component devices different from one another according to connection modes with respect to the control apparatus and connection positions of the plurality of component devices, wherein the plurality of component devices includes a fan, a pipeline, and a valve, wherein the control apparatus displays a fan operation state of the fan as a rotating image of rotational blades and a rotation speed of the fan as a color, wherein if the pipeline has a flow of a fluid, the control apparatus displays the flow divided into a blue color and a red color based on a temperature, and wherein the control apparatus displays an on/off status of the valve in a valve form and a color change.

2. The apparatus for controlling the air conditioner as claimed in claim 1, wherein the plurality of component devices of the air conditioner further includes at least one outdoor device and a plurality of indoor devices connected to the at least one outdoor device.

3. The apparatus for controlling the air conditioner as claimed in claim 2, wherein the control apparatus is configured to receive the cycle data from at least one of the at least one outdoor device or one of the plurality of indoor devices connected to the at least one outdoor device.

4. The apparatus for controlling the air conditioner as claimed in claim 2, wherein the control apparatus is configured to be connected to at least one of the at least one outdoor device, one of the plurality of indoor devices, or a communication line that connects the at least one outdoor device and the plurality of indoor devices.

5. The apparatus for controlling the air conditioner as claimed in claim 4, wherein if the control apparatus is connected to the one of the plurality of indoor devices of the air conditioner, the control apparatus displays the cycle data for the plurality of component devices received through the one of the plurality of indoor devices.

6. The apparatus for controlling the air conditioner as claimed in claim 4, wherein if the control apparatus is connected to the communication line, the control apparatus receives and displays communication data transmitted and received between the plurality of component devices and a central controller of the air conditioner.

7. The apparatus for controlling the air conditioner as claimed in claim 6, wherein the control apparatus analyzes the communication data to determine an operation state of each of the plurality of component devices, and displays the cycle data for the plurality of component devices changing the cycle data according to a control setting by the central controller.

8. The apparatus for controlling the air conditioner as claimed in claim 1, wherein the control apparatus determines the connection modes according to a port, or received data.

9. The apparatus for controlling the air conditioner as claimed in claim 1, wherein the control apparatus includes:

an input;

the output to display the cycle data;

a communication device connected to the plurality of component devices to transmit and receive the cycle data; and a processor that determines the connection modes of the plurality of component devices through the communication device, receives the cycle data and displays the cycle data on the frame on the output.

10. The apparatus for controlling the air conditioner as claimed in claim 1, wherein the plurality of component devices further includes a plurality of outdoor devices and a plurality of indoor devices, wherein the control apparatus displays information on the plurality of outdoor devices and the plurality of indoor devices in an order of times in succession, and wherein the control apparatus controls speed of changes for displaying the information.

11. A method for operating a control apparatus for an air conditioner, the method comprising:

sensing a plurality of components devices of the air conditioner or a connection mode of each of the plurality of component devices to the control apparatus, wherein the control apparatus is connected to a network of the plurality of component devices, and wherein the plurality of component devices includes a fan, a pipeline, and a valve;

receiving data, including data corresponding to at least one of the plurality of components devices, or the connection modes;

producing the received data for the plurality of component devices in a frame on an output based on the received data corresponding to the at least one of the plurality of components devices or the connection modes, wherein if the control apparatus is connected to one of the plurality of component devices, the control apparatus requests data for the plurality of component devices and receives the data, and if the control apparatus is connected to a communication line in the network, the control apparatus receives communication data transmitted between a central controller of the air conditioner and the plurality of component devices; and displaying the received data, wherein the displaying the received data includes displaying a fan operation state of the fan as a rotating image of rotational blades and a rotation speed of the fan as a color, wherein if the pipeline has a flow of a fluid, the displaying the received data includes displaying the flow divided into a blue color and a red color based on a temperature, and wherein the displaying the received data further includes displaying an on/off status of the valve in a valve form and a color change.

12. The method as claimed in claim 11, wherein if the control apparatus is connected to the one of the plurality of component devices or to the communication line, the data received. are different from one another.

13. The method as claimed in claim 11, wherein if the control apparatus is connected to the one of the plurality of component devices or to the communication line in the network, the data for the plurality of component devices are displayed different from one another.

14. The method as claimed in claim 11, wherein the plurality of component devices of the air conditioner further includes at least one outdoor device and a plurality of indoor devices connected to the at least one outdoor device.

15. The method as claimed in claim 11, wherein the plurality of component devices further includes a plurality of outdoor devices and a plurality of indoor devices, wherein the control apparatus displays information on the plurality of outdoor devices and the plurality of indoor devices in an order of times in succession, and wherein the control apparatus controls speed of changes for displaying the information.

16. An apparatus for controlling an air conditioner, the air conditioner including a plurality of component devices, including at least one outdoor device and a plurality of indoor devices connected to the at least one outdoor device, the apparatus comprising:

a control apparatus in communication with at least one of the plurality of component devices of the air conditioner to monitor and control the plurality of component devices, wherein the control apparatus receives cycle data that enables problem diagnosis on the plurality of component devices from the plurality of component devices, in real time, and displays the cycle data on a frame on an output, wherein the control apparatus displays the cycle data for the plurality of component devices different from one another according to connection modes with respect to the control apparatus and connection positions of the plurality of component devices, wherein the plurality of component devices further includes a fan, a pipeline, and a valve, wherein the control apparatus displays a fan operation state of the fan as a rotating image of rotational blades and a rotation speed of the fan as a color, wherein if the pipeline has a flow of a fluid, the control apparatus displays the flow divided into a blue color and a red color based on a temperature, and wherein the control apparatus displays an on/off status of the valve in a valve form and a color change.

17. The apparatus for controlling the air conditioner as claimed in claim 16, wherein the control apparatus is configured to receive the cycle data from at least one of the at least one outdoor device or one of the plurality of indoor devices connected to the at least one outdoor device.

18. The apparatus for controlling the air conditioner as claimed in claim 16, wherein the control apparatus is configured to be connected to at least one of the at least one outdoor device, one of the plurality of indoor devices, or a communication line that connects the at least one outdoor device and the plurality of indoor devices.

19. The apparatus for controlling the air conditioner as claimed in claim 16, wherein the control apparatus determines the connection modes according to a port, or received data.

20. The apparatus for controlling the air conditioner as claimed in claim 16, wherein the control apparatus includes:

an input;

the output to display the cycle data;

a communication device connected to the plurality of component devices to transmit and receive the cycle data; and a processor that determines the connection modes of the plurality of component devices through the communication device, receives the cycle data, and displays the cycle data on the frame on the output.

21. The apparatus for controlling the air conditioner as claimed in claim 16, wherein the at least one outdoor device includes a plurality of outdoor devices, wherein the control apparatus displays information on the plurality of outdoor devices and the plurality of indoor devices in an order of times in succession, and wherein the control apparatus controls speed of changes for displaying the information.

22. A method for operating a control apparatus for an air conditioner, the air conditioner including a plurality of component devices, including at least one outdoor device and a plurality of indoor devices connected to the at least one outdoor device, the method comprising:

sensing a plurality of components devices of the air conditioner or a connection mode of each of the plurality of component devices to the control apparatus, wherein the control apparatus is connected to a network of the plurality of component devices, and wherein the plurality of component devices includes a fan, a pipeline, and a valve;

receiving data, including data corresponding to at least one of the plurality of components devices or the connection modes;

producing the received data for the plurality of component devices in a frame on an output based on the received data corresponding to the at least one of the plurality of components devices or the connection modes, wherein if the control apparatus is connected to one of the plurality of component devices, the control apparatus requests data for the plurality of component devices and receives the data, and if the control apparatus is connected to a communication line in the network, the control apparatus receives communication data transmitted between a central controller of the air conditioner and the plurality of component devices; and displaying the received data, wherein the displaying the received data includes displaying a fan operation state of the fan as a rotating image of rotational blades and a rotation speed of the fan as a color, wherein if the pipeline has a flow of a fluid, the displaying the received data includes displaying the flow divided into a blue color and a red color based on a temperature, and wherein the displaying the received further data includes displaying an on/off status of the valve in a valve form and a color change.

23. The method as claimed in claim 22, wherein if the control apparatus is connected to the one of the plurality of component devices or to the communication line, the data received are different from one another.

24. The method as claimed in claim 22, wherein if the control apparatus is connected to the one of the plurality of component devices or to the communication line in the network, the data for the plurality of component devices are displayed different from one another.

25. The method as claimed in claim 22, wherein the plurality of component devices further includes a plurality of outdoor devices and a plurality of indoor devices, wherein the control apparatus displays information on the plurality of outdoor devices and the plurality of indoor devices in an order of times in succession, and wherein the control apparatus controls speed of changes for displaying the information.

* * * * *